US005954330A

United States Patent [19]

Rabindran et al.

[11] Patent Number: 5,954,330

[45] Date of Patent: Sep. 21, 1999

[54] METHOD AND APPARATUS FOR SYNCHRONIZING A DOCUMENT FEEDER WITH A MAIL SORTING CONVEYOR

[75] Inventors: George Rabindran, Morton Grove; David Filicicchia, Schaumburg; Michael Wisniewski, Bowling Brook, all of Ill.

[73] Assignee: Bell & Howell Postal Systems Inc., Lincolnwood, Ill.

[21] Appl. No.: 08/753,584

[22] Filed: Dec. 2, 1996

[51] Int. Cl.[6] ..... B65H 5/38

[52] U.S. Cl. ..... 271/270; 271/265.01; 271/275; 198/357

[58] Field of Search ..... 271/9.12, 9.13, 271/182, 199, 202, 203, 265.01, 270, 225, 272, 275; 198/357, 358

[56] References Cited

U.S. PATENT DOCUMENTS 4,632,381 12/1986 Cuir et al. ..... 271/203 X
5,038,911 8/1991 Doane et al. ..... 198/357
5,421,699 6/1995 Guiles et al ..... 271/9.13
5,617,804 4/1997 Savio ..... 271/9.13

*Primary Examiner*—Boris Milef
*Attorney, Agent, or Firm*—Sonnenschein Nath & Rosenthal

[57] ABSTRACT

An apparatus and method of synchronizing entry of a mailpiece from a mail feeder into a designated mailpiece location of a mail sorting conveyor. The method includes the steps of establishing a symmetric speed versus time profile around a send signal. In a first case, when the mailpiece stops before receiving the send signal, the method further includes following the speed versus time profile to accelerate to a merge speed for merging the mailpiece with the designated mail location of the sorting conveyor. In a second case, when the send signal arrives before the mailpiece reaches the stop position, holding the mailpiece at a constant speed across the speed versus time profile until the position of the mailpiece intersects an opposing side of the speed versus time profile and then following the speed versus time profile to accelerate the mailpiece to a merge speed for merging the mailpiece within the designated mail location of the sorting conveyor.

15 Claims, 5 Drawing Sheets

METHOD AND APPARATUS FOR SYNCHRONIZING A DOCUMENT FEEDER WITH A MAIL SORTING CONVEYOR

FIELD OF THE INVENTION

The present invention relates to automatic mail handling systems and more particularly to methods and apparatus for merging mail streams into discrete locations on a mail sorting conveyor.

BACKGROUND OF THE INVENTION

It is common practice in the automated handling of mail documents, such as mailing envelopes and flats, to progressively feed a stack of documents from a feeder station or feeder station magazine to a shingling station and then to a singulating station. The shingling station functions to partially separate the stack of mail into an overlapping stream. The singulating station completes the process of separating individual items of mail from the overlapping stack. The separated documents are then directed from the singulating stations to sorting stations or other processing stations or devices.

Postal requirements demand that a high volume of documents be handled in a short period of time. Typically, document handling devices are required to process thousands of documents per hour with a minimum of sorting defects and product damage. Often documents of varying sizes and shapes from a number of handling stations must be merged seamlessly into sorting processes.

Typically, the first stage in the document handling process after the documents have been placed in a container or tray with the labels facing the same direction, is to load the stack of documents onto a transport mechanism, such as a conveyor belt mechanism. The transport mechanism then directs the documents into the various separators and sorting devices.

Known systems and methods typically require substantial human intervention and action to load the stacks of documents from the tray or containers onto the document transport mechanism. The operator must gather the stacks of documents and place the documents on the conveyor belt so that all the documents are in an on-edge orientation. This must be performed while taking steps to prevent the stack from falling over. Additionally, these steps are typically performed as the conveyor belt is continuously advancing the stack of documents toward the various processing stations. This is a time-intensive process and is often one of the limiting factors in achieving high-speed document processing and throughput.

The documents are typically transported to an initial processing station, such as a shingling station, prior to singulation. Shingling results in orienting either the top or bottom document in a vertical stack, or the front or lead document in an on-edge stack, so that the forward or leading edge of each successive top, bottom or front document is disposed slightly forward or laterally of the leading edge of the next adjacent document. By shingling the stacked documents, only one document at a time will enter a nip defined by singulating belts or rollers, thereby substantially reducing the possibility that more than one document at a time will be fed simultaneously through the singulating belts or rollers. The singulating belts or rollers then transport each document in an on-edge single file manner toward other sorting and processing devices.

The other sorting and processing devices are often fed from a sorting conveyor which also operates in an on-edge orientation. The sorting conveyor is often constructed of fingered belts in which a set of projecting fingers spaced at pre-determined horizontal intervals along the belt define spaces for individual documents (i.e., designated document locations). The fingers both define the spaces and function to urge the documents along the sorting conveyor to the individual sorting stations.

As the documents move along the sorting conveyor, a zip code or other indicia of destination is read from the documents. At the sorting station, the documents found between the fingers of the sorting conveyor are discharged, either pneumatically or by actuator levers, into predetermined receiving bins.

To perform their designated function, the singulating stations must discharge the singulated documents onto the sorting conveyor between the fingers of the sorting conveyor. To place the documents between the fingers of the sorting conveyors, the singulating stations must be synchronized to the movement of the fingers of the sorting conveyor. Often this requires detecting a position of an envelope and adjusting a processing speed of the singulating station to match that of the sorting conveyor. Optical sensors may be used to detect either the lead or trail edge of the mail piece so that software can adjust the speed and relative position of the output documents of the singulating station to match the finger location of the sorting conveyor.

Because of the difficulty of loading and maintaining a constant flow of documents through the singulating stations, the sorting conveyors are often fed from a number of singulating stations. Where a number of singulating stations feed the same sorting conveyor, it is often difficult to coordinate and synchronize placement of the documents into the designated document locations. A means must be provided to avoid placing two envelopes from different feeders into the same location. Where an envelope overlaps a boundary of the designated location (e.g, a finger of the fingered belt), it becomes necessary to determine whether the envelope belongs in the prior location or subsequent location. Thus a means and apparatus for reliably synchronizing document placement into the sorting conveyor would greatly improve the rate at which documents could be handled in a mail processing system.

Accordingly, it is an object of the invention to provide a means and apparatus for precisely synchronizing the output of the singulating stations to the sorting conveyor.

It is a further object to provide a means and apparatus to synchronize the individual documents of an output of the singulating station to the fingers of the sorting conveyor, instead of synchronizing the entire singulating station.

SUMMARY OF THE INVENTION

An apparatus and method is provided for synchronizing entry of an envelope from a document feeder into a designated envelope location of a mail sorting conveyor. The method includes the steps of establishing a substantially symmetric speed versus time profile around a synchronization stop point on the merge module and stopping and holding the envelope at the stop point using a deceleration rate of the speed versus time profile until receipt of a send signal from the mail sorting conveyor. In a first case, the method further includes following the speed versus time profile to accelerate to a merge speed for merging the envelope within the designated mail location of the sorting conveyor. In a second case, when the send signal arrives before the envelope reaches the stop point, holding the envelope at a constant speed across the symmetric speed versus time profile until the position of the envelope intersects an opposing side of the speed versus time profile and then following the speed versus time profile to accelerate to a merge speed for merging the envelope within the designated mail location of the sorting conveyor.

DETAILED DESCRIPTION OF THE INVENTION

Figure 1:
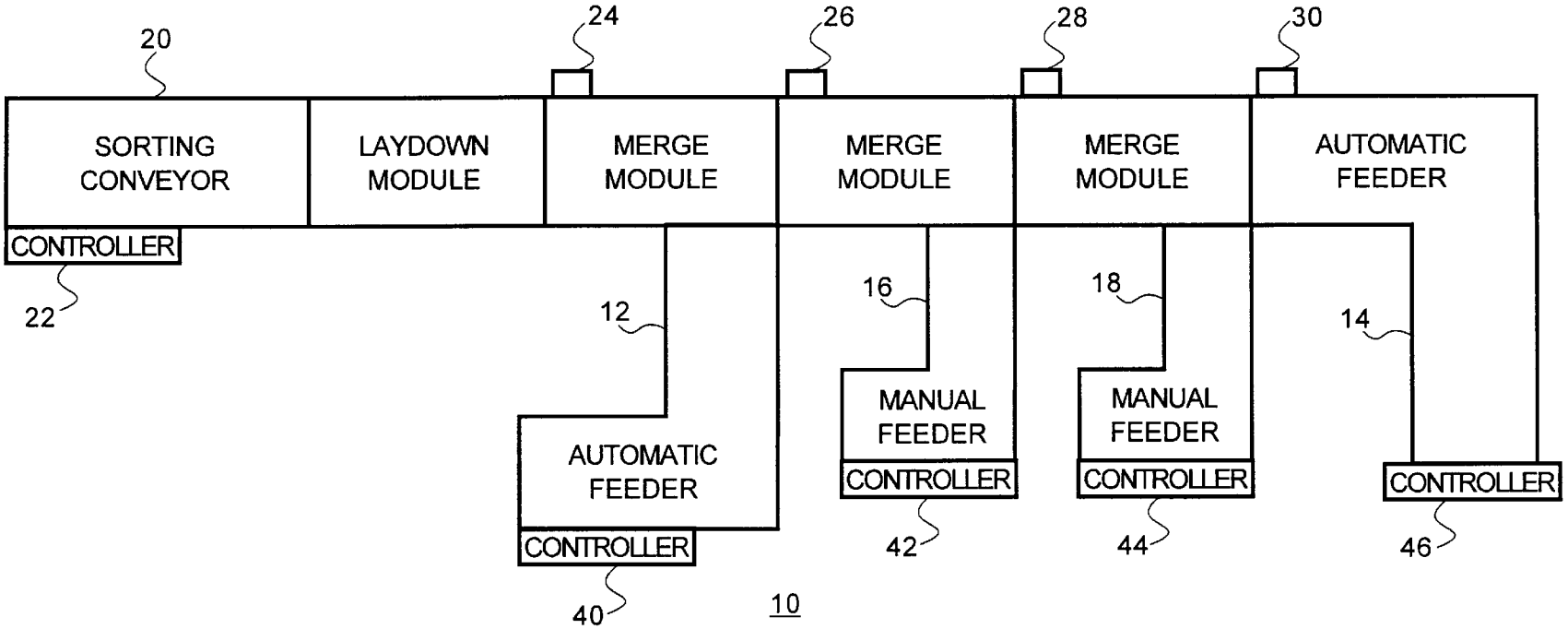
FIG. 1 is a block diagram of a mail sorting system in accordance with one embodiment of the invention.

FIG. 1 is a block diagram of an automatic mail sorting system 10, generally, in accordance with one embodiment of the invention. The mail sorting system 10 is of a type generally suited for handling envelopes, catalogs, or flat rectangular objects (e.g., flat boxes) no thicker than one inch (all generically referred to herein as mail or envelopes).

Included within the mail sorting system 10 are a number of automatic mail feeders 12, 14 and a number of manual feeders 16, 18. The automatic feeders 12, 14 and manual feeders 16, 18 are constructed to accept and feed mail to the sorting conveyor 20 on an individual basis and in sequence.

The automatic feeders 12, 14 may be constructed to automatically feed mail of a regular shape, size and weight. The manual feeders 16, 18 may be constructed to handle non-standard mail (e.g., oversized, overweight, non-standard size, etc.)

Figure 2:
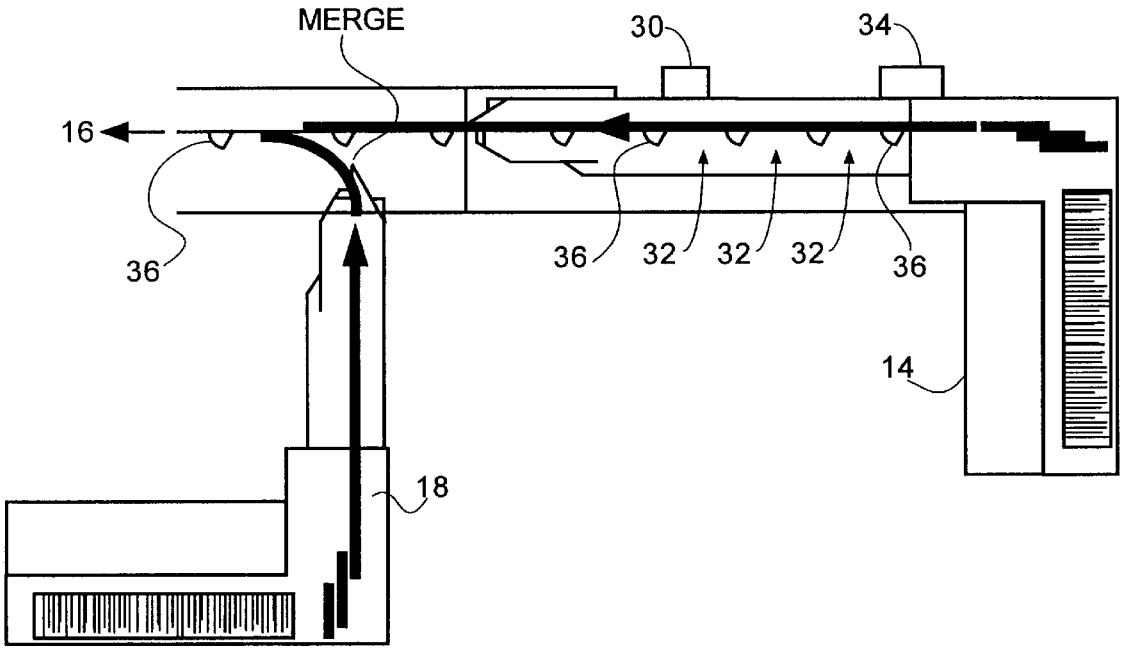
FIG. 2 depicts two feed stations of the sorting system of FIG. 1.

To feed mail to the sorting conveyor 20 in sequence, provision must be made to coordinate the activities of the feeders 12, 14, 16, 18. For example, if the first automatic feeder 14 were to fill every other designated location 32 (FIG. 2) between the fingers 36 of the sorting system, then operation of the downstream feeders 12, 16, 18 must be coordinated to prevent the downstream feeders 12, 16, 18 from also loading documents into those previously filled locations 32.

Controller 22 of the sorting conveyor 20 provides the function of coordinating the activity of the feeders 12, 14, 16, 18. The controller 22 may impose control by designating a destination of each location 32 of the sorting conveyor 20. Designating a destination of each location 32 of the sorting conveyor 20 allows the system 10 to accomplish preliminary sorting at the inputs to the sorting conveyor 20 from the feeders 12, 14, 16, 18.

Where a small number of repeating destinations 32 (e.g., four) are designated for the locations of the sorting conveyor 20, the result is a more even loading of the individual feeders 12, 14, 16, 18. For example, if the first automatic feeder 14 has a document destined for a particular geographic location, then the document could only be placed in one of four passing locations 32 of the sorting conveyor 20. The other three locations 32 then become available for use by the other feeders 12, 16, 18.

To impose control on the feeders 12, 14, 16, 18, the controller 22 simultaneously transmits a feed signal to the feeders 12, 14, 16, 18 containing an identifier of the destination of a location 32 of the sorting conveyor 20. The feed signal is transmitted as the designated location 32 passes the first feeder 14 based upon detection of a finger 36 of the sorting conveyor 20 by a photosensor 34. If the first feeder 14 has an envelope destined for that location 32, it is immediately deposited into that location 32 by the first feeder 14. A photosensor 30 detects the presence of the envelope within that location.

The detection of an envelope within a designated location 32 alerts downstream feeders 12, 16, 18 that the designated location is no longer available. Similarly, other photodetectors 24, 26, 28 (FIG. 1.) at an output of the second and later feeders 12, 16, 18 alert downstream feeders 12, 16 and the controller 22 of the presence of an envelope in a particular designated location 32.

If the location 32 is empty when it reaches the photosensor 30, then the next feeder 18 may insert an envelope into the location 32. The next feeder 18 delays insertion of its envelope from the time of detection of the feed signal. Since the second feeder 18 is further from the upstream end of the sorting conveyor 20, the time when the second feeder 18 will insert an envelope into the location 32 will be later than the time of insertion of the first feeder 14.

Figure 3:
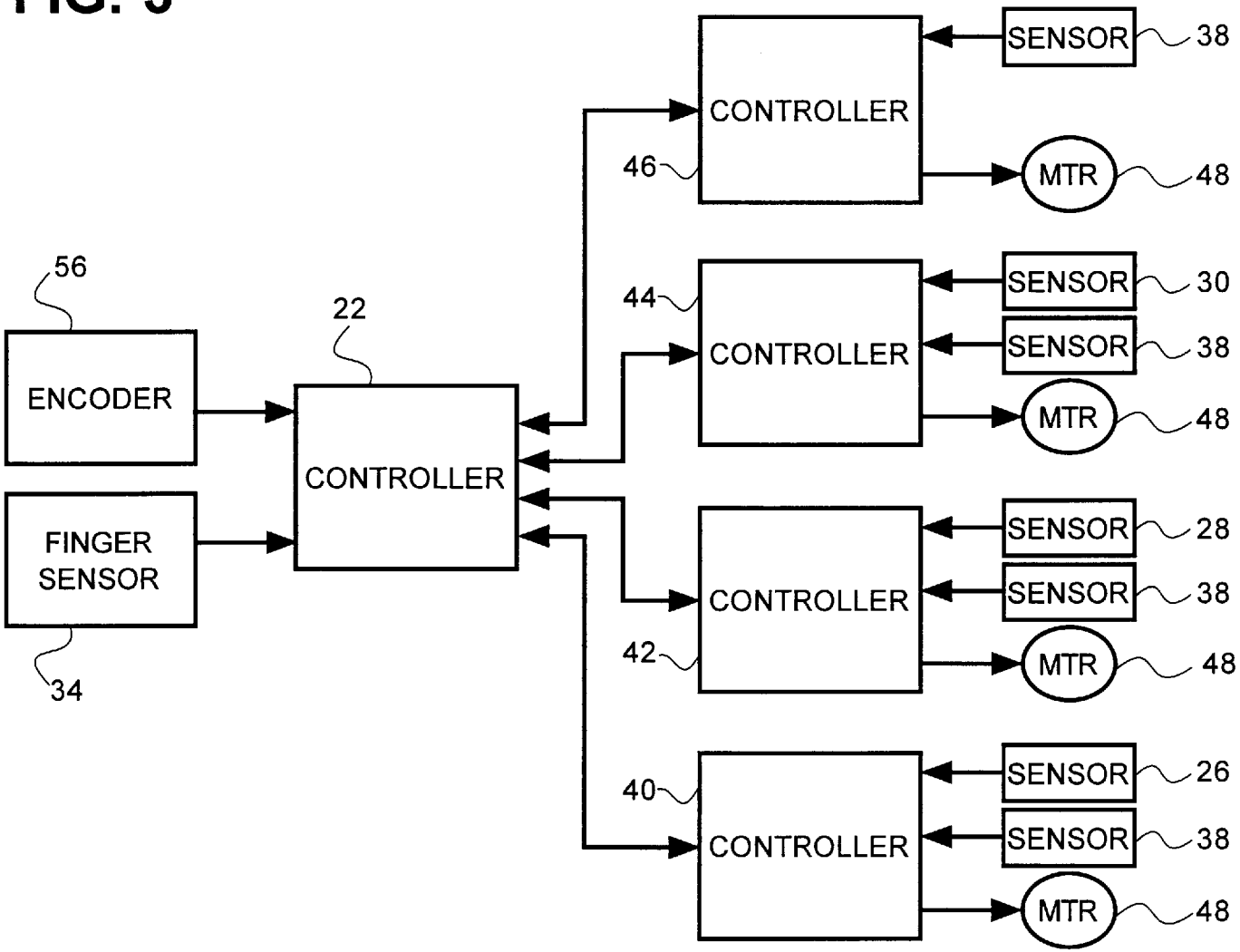
FIG. 3 is a block diagram of a control system for the sorting system of FIG. 1.

To deposit an envelope into a designated location 32 of the sorting conveyor 20, the feeder 12, 14, 16, 18 must synchronize insertion of the envelope with the position of the moving fingers 36 defining the boundaries of the designated location 32. The feeder 18 times the insertion of the envelope into the location 32 based upon an encoder signal provided to the feeder 12, 14, 16, 18 from the controller 22. The encoder signal from controller 22 provides a position indicator of the designated location 32 at any particular instant in time. The encoder signal may be an output of an optical encoder 56 (FIG. 3.) mechanically coupled to a shaft of the sorting conveyor, or may be a pulse train of a stepper motor used to drive the sorting conveyor 20.

The description given herein relative to the insertion of envelopes into a designated location of the sorting conveyor 20 will be provided in terms of a single designated location. It should be understood that the sorting conveyor 20 has as many designated locations 32 as fingers 36 on the belt, and the controller 22 of the sorting conveyor 20 controls each designated location in a similar manner.

FIGS. 3–5*a, b* and *c* will now be used to explain the operation of the merge module 50 (FIG. 4) and associated pitch control unit (PCU). The merge module 50 will generally be used to refer to the mechanical interface between the feed conveyors 12, 14, 16, 18 and sorting conveyor 20. The PCU will generally be used to refer to the timing and electromechanical controllers 40, 42, 44, 46 (FIG. 3.) used to merge the envelope into the designated location 32 of the sorting conveyor 20.

Figure 4A:
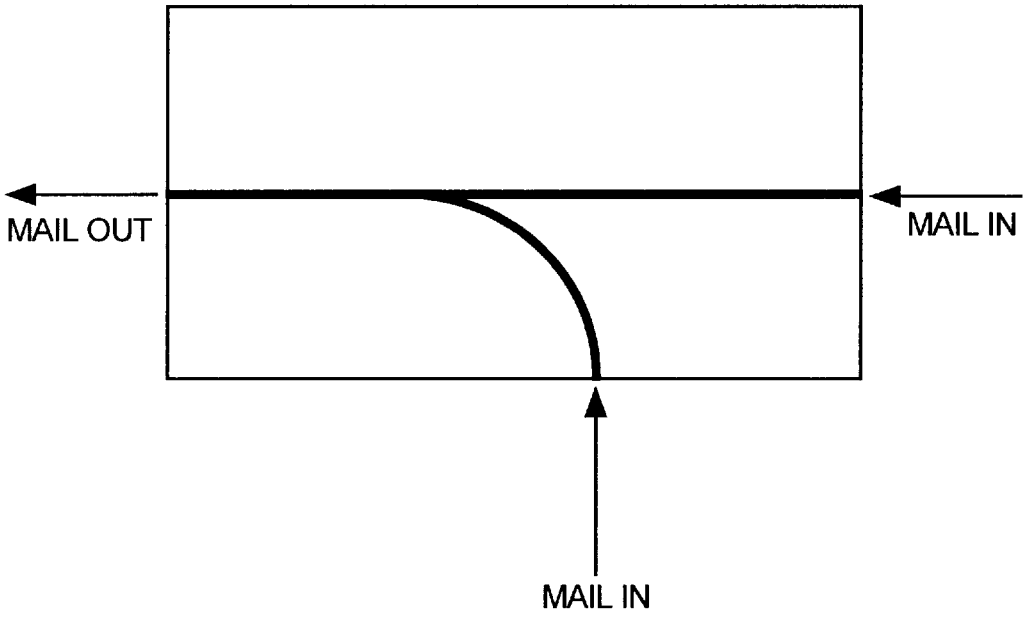
FIGS. 4*a* and 4*b* depict a schematic and detailed view of a merge module of the feed stations of FIG. 2.
Figure 4B:
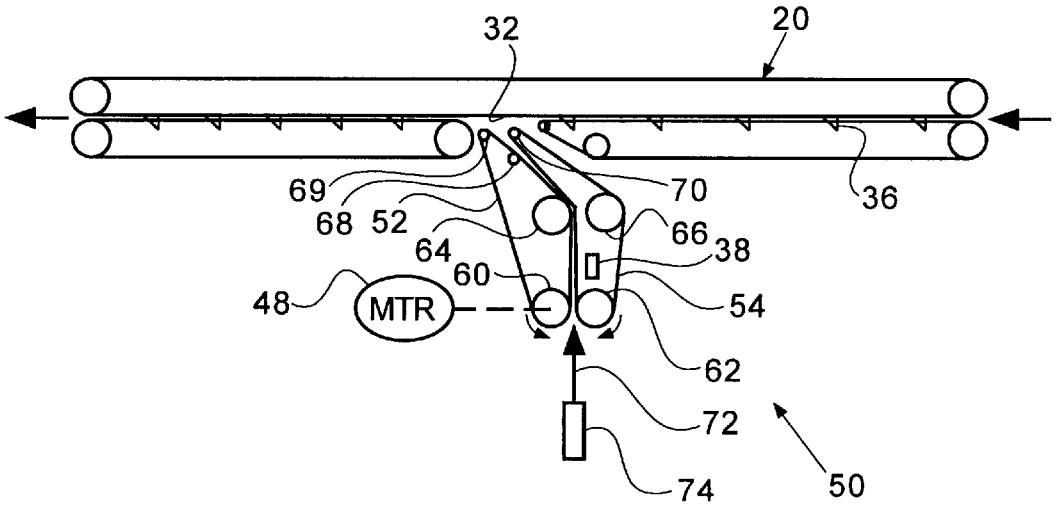

As shown schematically in FIGS. 4*a* and in more detail in 4*b*, the merge module 50 may be constructed of a pair of belts 52, 54 passing over a set of rollers 60, 62, 64, 66, 68, 69, 70. The spacing of a pair of entry rollers 60, 62 is designed to cause the belts 52, 54 to form a nip to grasp and hold envelopes inserted into the merge module 50 for subsequent insertion into the designated location 32 of the sorting conveyor 20. A third roller 64 maintains the pressure of one belt 52 against the other belt 54 during envelope transfer. A fourth roller 68 performs a similar function. The merge module 50 accepts an envelope 74 at a first end 72 from a singulator of the feeders 12, 14, 16, 18 and deposits the envelope into the designated location 32 of the sorting conveyor 20.

As shown in FIG. 2B, rollers 60, 62 are driven in opposite directions by a variable speed motor 48 to pull the envelope into the merge module 50 and merge it with the main conveyor 20.

To aid in merging an envelope with the main conveyor 20 in the illustrated embodiment, a photosensor 38 is provided on the merge module 50. The photosensor 38 provides position signals of a trailing edge of an envelope appropriate for establishing the precise timing necessary to merge an envelope within a designated location on the main conveyor 20.

The method used to synchronize entry of an envelope into the designated location of the main conveyor 20 will be explained by reference to FIGS. 5*a,* 5*b* and 5*c.* FIGS. 5*a,* 5*b* and 5*c* show velocity versus time profiles including deceleration and acceleration lines representing the deceleration and acceleration rates of an envelope as it moves through the merge module 50.

Figure 5A:
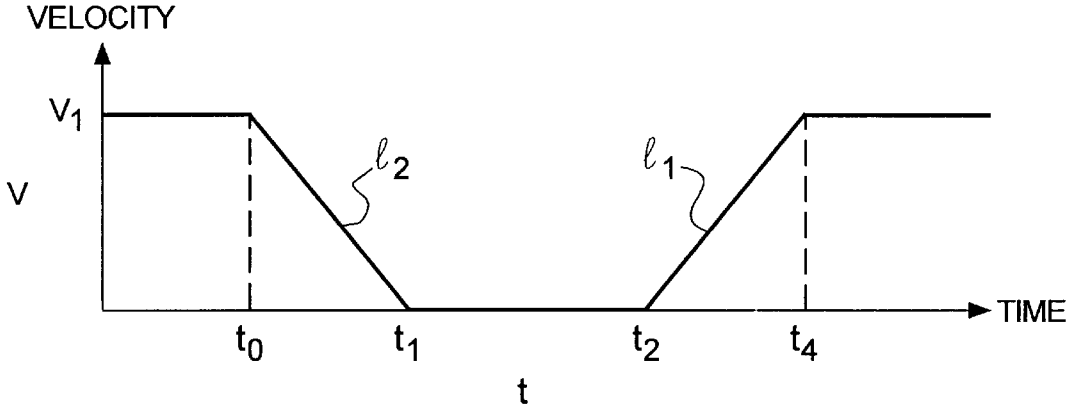
FIGS. 5*a* and 5*b* depict velocity/time profiles for an envelope on the merge module of FIG. 4.

As shown in FIG. 5*a,* an envelope progresses along the merge conveyor 50 at a constant velocity $V_1$ (also referred to as mail infeed velocity) until being detected at time $t_0$. At time $t_0$, in the absence of a send signal from controller 22, the envelope decelerates at a constant deceleration rate $\mathbf{1}_1$ to a stop (shown in FIG. 5*a* as time $t_1$). At time $t_2$, an envelope send signal is received which causes the envelope to accelerate $\mathbf{1}_2$ at a constant acceleration rate to a velocity $V_1$ at $t_4$, until the envelope merges with the sorting conveyor 20.

Figure 5B:
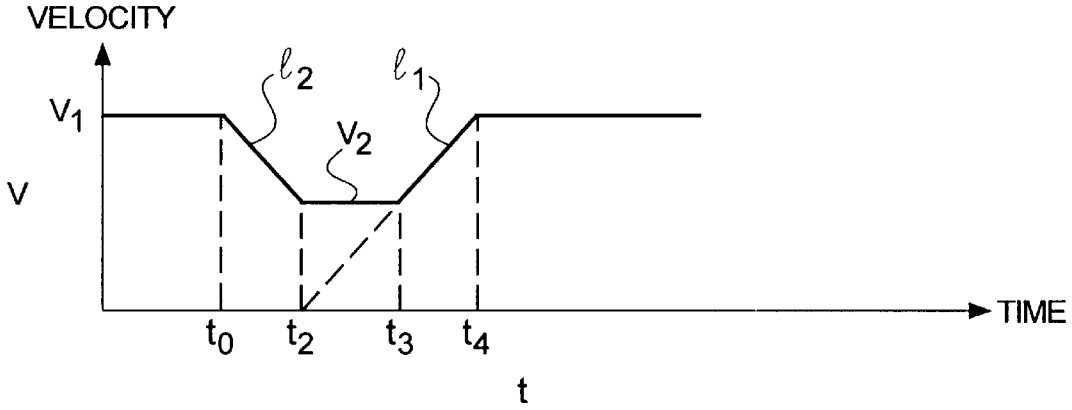

In the alternative, referring to FIG. 5*b,* if the envelope were decelerating from velocity $V_1$ subsequent to $t_2$ and a send signal were received at time $t_2$ before the envelope stopped, the envelope then assumes a constant velocity, $V_2$ (also referred to as mail holding velocity). At time $t_3$, $V_2$ intersects with line $\mathbf{1}_1$, an acceleration curve originating at V=0 at $t_2$, and extending at a slope from the t axis which is the same slope as deceleration line $\mathbf{1}_2$ were line $\mathbf{1}_2$ extended from $V_1$, to the V=0 axis. The envelope continues to accelerate until it reaches $V_1$ at $t_4$.

Figure 5C:
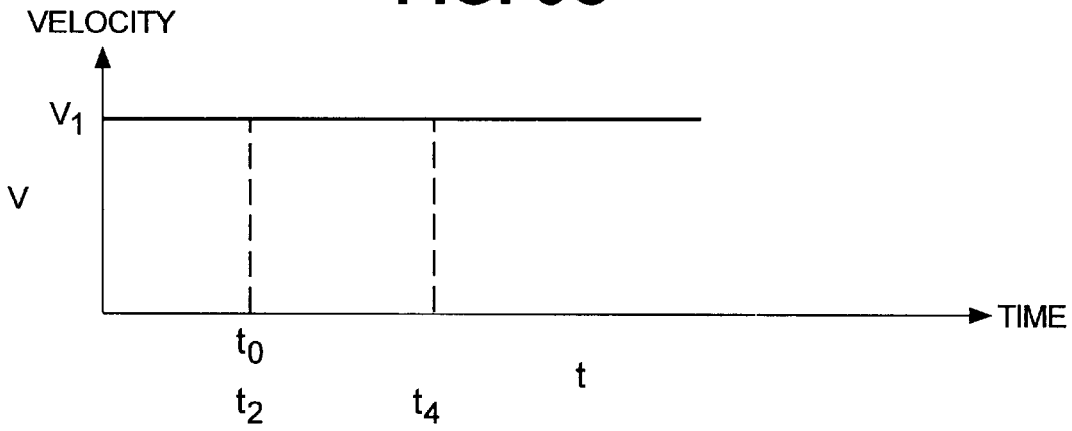
FIG. 5*c* is a velocity/time profile for an envelope on the merge module of FIG. 4 where a send signal is in place before the document passes the sensor.

In FIG. 5*c,* the send signal $t_2$ is received from controller 22 at or before the envelope reaches $t_0$. The velocity $V_1$ of the envelope is maintained until the envelope is deposited at the designated location 32 of the sorting conveyor 20.

Referring to FIGS. 5*a, b* and *c,* in the preferred embodiment, the areas under each curve between $t_0$ and $t_4$ will be equal. These areas represent the distance the envelope travels from the time it passes the sensor at to $t_0$ to the time it is ready to be inserted into the merge module at $t_4$. Also the time period between $t_2$ and $t^4$ must be equal in all situations.

While the merge module 50 (FIG. 4*b*) is at idle, the belts 52, 54 operate at a constant speed $V_1$. The envelope enters the merge module 50 at speed $V_1$. As the envelope progresses through the merge module 50, a controller 40, 42, 44, 46 of the respective merge module 50 detects the envelope through the photosensor 38 at $t_0$ (FIG. 5*a*). Upon detecting the envelope, the controller 40, 42, 44, 46 decelerates the envelope to a stop at time $t_1$ at a constant deceleration rate $\mathbf{1}_2$. The controller 40, 42, 44, 46 holds the envelope at the stop position between the time period $t_2$ minus $t_1$ until receipt of a send signal from the controller 22 of the main conveyor 20, which occurs at $t_2$. Where the envelope is being held in the merge conveyor 50 of the first feeder 14, the receipt of the send signal causes the controller 46 of the first feeder 14 to immediately activate the merge module 50 and merge the envelope with the designated location 32 of the main conveyor 20.

Where the envelope is being held in the merge conveyor 50 of the second and later feeders 12, 16, 18, the receipt of the send signal by its respective controller unit causes the controller 44 to begin a delay period sufficient for the designated location 32 on the main conveyor 20 to move from a location proximate the main conveyor photosensor 34 (and first feeder 14) to a position proximate the second and later feeders 12, 16, 18. To determine the length of the delay, the controller 44 monitors the position feedback provided by the encoder 56 attached to a drive shaft of the main conveyor 20. The controller 44 may accomplish this by loading a distance value into a register equivalent to the distance between the photosensor 34 and the feeder 18 and decrementing the register based upon feedback signals from the encoder 56. At the appropriate moment, the controller 44 causes the merge conveyor 50 to merge the envelope into the designated location of the main conveyor 20. Similarly, the other feeder locations 12, 16 also merge envelopes from their merge conveyors 50 into the main conveyor 20 based upon their distance from the main conveyor photosensor 34.

In the alternative, the controller 22 of the main conveyor 20 may send a unique send signal to each feeder 12, 14, 16, 18. Where this technique is used, the controller 22 includes with the send signal a destination of the designated location. The local controller 40, 42, 44, 46 then determines whether the designated location is appropriate for the envelope being held in its merge module 50.

An explanation will now be provided as to the method used to merge an envelope from the merge module 50 to the main conveyor 20. For purposes of ease of explanation, it will be assumed that the envelope will be merged immediately after receipt of the send signal. While this assumption is correct only in the case of the first feeder 14, it should be recognized that the only difference is that subsequent feeders 12, 16, 18 must also delay the instant of merging until such time as the designated recipient location of the main conveyor 20 progresses to a location proximate that of feeder 12, 16, 18.

When the controller 46 receives a send signal from the controller 22 of the main conveyor 20, the controller 46 accelerates the envelope at a constant acceleration $\mathbf{1}_1$ to the constant velocity $V_1$ (FIG. 5*a*). The belts of the merge module 50 then advance the envelope from the stopped location at $t_2$ to the designated location 32 of the main conveyor 20. Under an embodiment of the invention, the constant velocity $V_1$ may be calculated to deliver the envelope to the passing designated location at the proper instant based upon the length of the merge conveyor.

Under the illustrated embodiment of FIG. 5*b,* it has been determined that an envelope may also be successfully merged after detection by the merge photosensor 38 without bringing an envelope to a complete stop at the stop location $t_1$ as designated in FIG. 5*a.* It has been determined that a successful merge may be accomplished by making the deceleration rate $\mathbf{1}_1$ equal the acceleration rate $\mathbf{1}_2$, and having the envelope assume a constant velocity at the instant of receipt of the send signal.

The creation of a systematic speed versus time profile as previously set forth may be accomplished by a number of known methods using known hardware. For example, a commercially available servo device may be provided with programmable acceleration/deceleration profiles based upon the occurrence of a predetermined event (e.g., actuation of a position sensor). Alternatively, the speed/time profile may be based upon a lookup table relating velocity to time.

The present invention can be used in various other document feeder and sorter combinations. For example, a single document feeder delivering documents directly into a sorter can utilize the same inventive concepts described above and claimed herein. Also, pocket type sorters may be used in place of the finger/belt sorter described above.

Specific embodiments of a novel method and apparatus for merging envelopes into a mail sorting system according to the present invention have been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover by the present invention any and all modifications, variations, or equivalents that fall within the true spirit and scope of the basic underlying principles disclosed and claimed herein.

We claim:

1. A method of synchronizing entry of a mailpiece from a mail feeder into a designated mailpiece location of a mail sorting conveyor, such method comprising the steps of:

establishing a symmetric speed versus time profile based upon the receipt of a send signal by the mail feeder, the speed versus time profile having a deceleration line and an acceleration line each respectively representing a deceleration rate and an acceleration rate;

stopping and holding the mailpiece at a predesignated stop position using the deceleration rate of the speed versus time profile until receipt of the send signal, and then following the speed versus time profile to accelerate the mailpiece to a constant mail infeed speed for merging the mailpiece with the designated mail location of the sorting conveyor.

2. The method as in claim 1 wherein the deceleration rate is relatively constant.

3. Apparatus for merging a mailpiece from a mail feed station into a designated mailpiece location of a constant speed mail sorting conveyor, such apparatus comprising:

means for advancing the mailpiece to a synchronization stop position along a merge conveyor from the feed station to the sorting conveyor at a relatively constant mail infeed speed;

means for decelerating the mailpiece as the mailpiece approaches the stop position using a relatively constant deceleration rate along a pre-determined deceleration line of a speed versus time profile from the relatively constant mail infeed speed toward the stop position;

means for receiving a send signal from the mail sorting conveyor;

means for accelerating the mailpiece at a relatively constant acceleration rate substantially equal to the substantially constant deceleration rate from the stop position to the relatively constant mail infeed speed along a pre-determined acceleration line of the speed versus time profile, where the mailpiece has reached the stop position upon receipt of the send signal;

means for maintaining the speed of the mailpiece at a constant mail holding speed until the mailpiece's speed intersects the acceleration line and then accelerating the mailpiece at a relatively constant acceleration rate from the intersection point to the relatively constant mail infeed speed along the pre-determined acceleration line, where the mailpiece has not reached the stop position upon receipt of the send signal, but has begun to decelerate toward the stop position; and means for merging the mailpiece with the designated mailpiece position on the mail sorting conveyor.

4. A method of synchronizing entry of a mailpiece from a mail feeder into a designated mailpiece location of a mail sorting conveyor, such method comprising the steps of:

establishing a symmetric speed versus time profile based upon the receipt of a send signal by the mail feeder prior to the mailpiece reaching a predesignated stop position;

maintaining the mailpiece at a constant mail holding speed across the speed versus time profile until the position of the mailpiece intersects an opposing side of the symmetric speed versus time profile, and then following the speed versus time profile to accelerate the mailpiece to a constant mail infeed speed for merging the mailpiece within the designated mail location of the sorting conveyor.

5. The method as in claim 4 further comprising the step of determining the constant mail holding speed across the speed versus time profile based upon a mailpiece speed at the instant of receipt of the send signal.

6. The method as in claim 4 wherein the step of maintaining the mailpiece at a constant speed across the speed versus time profile until the speed of the mailpiece intersects an opposing side of the symmetric speed versus time profile and then following the speed versus time profile further comprises: maintaining the speed of the mailpiece at a constant mail holding speed until the mailpiece's speed intersects the acceleration line, and then accelerating the mailpiece at a relatively constant acceleration rate from the intersection point to the relatively constant mail infeed speed along the pre-determined acceleration line.

7. The method as in claim 6 further comprising the step of merging the mailpiece with a designated mail location on the sorting conveyor.

8. Apparatus for synchronizing entry of a mailpiece from a mail feeder into a designated mailpiece location of a mail sorting conveyor, such apparatus comprising:

means for establishing a symmetric speed versus time profile based upon the receipt of a send signal by the mail feeder, the speed versus time profile having a deceleration line and an acceleration line each representing a deceleration rate and an acceleration rate respectively;

means for stopping and holding the mailpiece at a predesignated stop position using the deceleration rate of the speed versus time profile until receipt of the send signal and then following the speed versus time profile to accelerate the mailpiece to a constant mail infeed speed for merging the mailpiece with the designated mail location of the sorting conveyor.

9. The apparatus as in claim 8 wherein the deceleration rate is relatively constant.

10. Apparatus for synchronizing entry of a mailpiece from a mail feeder into a designated mailpiece location of a mail sorting conveyor, comprising:

means for establishing a symmetric speed versus time profile based upon the receipt of a send signal by the mail feeder;

means for maintaining the mailpiece at a constant mail holding speed across the speed versus time profile, when the send signal arrives before the mailpiece reaches a stop position, until the speed of the mailpiece intersects an opposing side of the speed versus time profile, and then following the speed versus time profile to accelerate the mailpiece to a constant mail infeed speed for merging the mailpiece with the designated mail location of the sorting conveyor.

11. The apparatus as in claim 10 further comprising means for determining the constant mail holding speed across the speed versus time profile based upon a mailpiece speed at the instant of receipt of the send signal.

12. The apparatus as in claim 10 wherein the means for maintaining the mailpiece at a constant speed across the speed versus time profile until the speed of the mailpiece intersects an opposing side of the symmetric speed versus time profile and then following the speed versus position profile, further comprises:

means for maintaining the speed of the mailpiece at a constant mail holding speed until the mailpiece's speed intersects the acceleration line and then accelerating the mailpiece at a relatively constant acceleration rate from the intersection point to the relatively constant mail infeed speed along the pre-determined acceleration line.

13. A method of synchronizing entry of a mailpiece from a mail feeder into a designated mailpiece location of a mail sorting conveyor, comprising the steps of:

decelerating the mailpiece from a relatively constant mail infeed speed to a synchronization stop position along a pre-determined constant deceleration line of a speed versus time profile;

receiving a send signal from the mail sorting conveyor;

where the mailpiece has reached the stop position upon receipt of the send signal, accelerating the mailpiece from the stop position to the mail feeder speed along a pre-determined acceleration line of the speed versus time profile having a slope substantially equal to the slope of the deceleration line;

where the mailpiece has not reached the stop position upon receipt of the send signal, maintaining the speed of the mailpiece at a constant mail holding speed until the mailpiece's speed intersects the acceleration line and then accelerating the mailpiece from the intersection point to the relatively constant mail infeed speed along the pre-determined acceleration line; and merging the mailpiece with the designated mailpiece position on the mail sorting conveyor.

14. A method of synchronizing entry of a mailpiece from a mail feeder into a designated mailpiece location of a mail sorting conveyor, comprising the steps of:

decelerating the mailpiece from a mail infeed speed as the mailpiece approaches a synchronization stop position along a pre-determined constant deceleration line of a speed versus time profile;

receiving a send signal from the mail sorting conveyor;

where the mailpiece has reached the stop position upon receipt of the send signal, accelerating the mailpiece from the stop position to the mail infeed speed along a pre-determined acceleration line of the speed versus time profile;

where the mailpiece has not reached the stop position upon receipt of the send signal, but has begun to decelerate toward the stop position, maintaining the speed of the mailpiece at a constant mail holding speed until the mailpiece's speed intersects the acceleration line and then accelerating the mailpiece from the intersection point to the relatively constant mail infeed speed along the pre-determined acceleration line; and merging the mailpiece with the designated mailpiece position on the mail sorting conveyor.

15. A method of merging a mailpiece from a mail feed station into a designated mailpiece location of a constant speed mail sorting conveyor, such method comprising the steps of:

advancing the mailpiece to a synchronization stop position along a merge conveyor from the feed station to the sorting conveyor at a relatively constant mail infeed speed;

decelerating the mailpiece as the mailpiece approaches the stop position using a relatively constant deceleration rate along a predetermined deceleration line of a speed versus time profile from the relatively constant mail infeed speed toward the stop position;

receiving a send signal from the mail sorting conveyor;

where the mailpiece has reached the stop position upon receipt of the send signal, accelerating the mailpiece at a relatively constant acceleration rate substantially equal to the substantially constant deceleration rate from the stop position to the relatively constant mail infeed speed along a pre-determined acceleration line of the speed versus time profile;

where the mailpiece has not reached the stop position upon receipt of the send signal, but has begun to decelerate toward the stop position, maintaining the speed of the mailpiece at a constant mail holding speed until the mailpiece's speed intersects the acceleration line and then accelerating the mailpiece at a relatively constant acceleration rate from the intersection point to the relatively constant mail infeed speed along the pre-determined acceleration line; and merging the mailpiece with the designated mailpiece position on the mail sorting conveyor.

* * * * *